US008062182B2

(12) United States Patent
Somers

(10) Patent No.: US 8,062,182 B2
(45) Date of Patent: Nov. 22, 2011

(54) EXERCISE MONITORING SYSTEM

(75) Inventor: Jonathan Somers, Tucker, GA (US)

(73) Assignee: TuffStuff Fitness Equipment, Inc., Pomona, CA (US)

( * ) Notice: Subject to any disclaimer, the term of this patent is extended or adjusted under 35 U.S.C. 154(b) by 0 days.

(21) Appl. No.: 12/698,023

(22) Filed: Feb. 1, 2010

(65) Prior Publication Data

US 2010/0216603 A1 Aug. 26, 2010

Related U.S. Application Data

(60) Provisional application No. 61/208,297, filed on Feb. 24, 2009.

(51) Int. Cl.
*A63B 71/00* (2006.01)

(52) U.S. Cl. ..... 482/8

(58) Field of Classification Search ..... 482/8, 93, 482/99

See application file for complete search history.

(56) References Cited

U.S. PATENT DOCUMENTS

| | | | | |
|---|---|---|---|---|
| 4,408,183 | A | 10/1983 | Wills | |
| 4,828,257 | A | 5/1989 | Dyer et al. | |
| 4,907,795 | A | 3/1990 | Shaw et al. | |
| 5,785,632 | A * | 7/1998 | Greenberg et al. | 482/5 |
| 5,857,939 | A | 1/1999 | Kaufman | |
| 5,897,457 | A | 4/1999 | Mackovjak | |
| 5,916,063 | A | 6/1999 | Alessandri | |
| 5,931,763 | A | 8/1999 | Alessandri | |
| 6,090,017 | A | 7/2000 | Wang | |
| 6,231,481 | B1 | 5/2001 | Brock | |
| 6,358,188 | B1 * | 3/2002 | Ben-Yehuda et al. | 482/8 |
| 6,494,811 | B1 * | 12/2002 | Alessandri | 482/8 |
| 6,656,091 | B1 | 12/2003 | Abelbeck et al. | |
| 6,669,600 | B2 | 12/2003 | Warner | |
| 6,749,538 | B2 | 6/2004 | Slawinski et al. | |
| 6,793,607 | B2 | 9/2004 | Neil | |
| 6,921,351 | B1 | 7/2005 | Hickman et al. | |
| 7,480,512 | B2 | 1/2009 | Graham et al. | |
| 2003/0032529 | A1 * | 2/2003 | Alessandri et al. | 482/94 |
| 2003/0171188 | A1 * | 9/2003 | Neil | 482/8 |
| 2005/0272561 | A1 * | 12/2005 | Cammerata | 482/8 |
| 2006/0234842 | A1 * | 10/2006 | Minami et al. | 482/99 |
| 2009/0176620 | A1 * | 7/2009 | Reynolds | 482/8 |

* cited by examiner

*Primary Examiner* — Loan Thanh
*Assistant Examiner* — Shila Jalalzadeh Abyane
(74) *Attorney, Agent, or Firm* — Alleman Hall McCoy Russell & Tuttle LLP

(57) ABSTRACT

An exercise monitoring system for use with an exercise device including a selectorized weight stack includes a static-stack light transmitter for transmitting a reference light to a static-stack reflector and a static-stack receiver positioned to receive reflected reference light from the static-stack reflector. The exercise monitoring system further includes a weight-determination module that outputs a weight indicator based on an amount of reflected static-stack reference light.

18 Claims, 5 Drawing Sheets

EXERCISE MONITORING SYSTEM

CROSS REFERENCE TO RELATED APPLICATIONS

This application claims the benefit of U.S. Provisional Patent Application No. 61/208,297, filed Feb. 24, 2009, the entirety of which is hereby incorporated by reference for all purposes.

BACKGROUND

Lifting weights using a weight lifting machine is a common way to exercise. Some weight lifting machines include a weight stack that may be adjusted by a user. For example, the user may choose to add more or less weight from the weight stack to increase or decrease the difficulty of a particular exercise. Users may want to perform a desired number of repetitions of an exercise or perform an exercise with a desired range of motion when using such weight lifting machines.

SUMMARY

An exercise monitoring system for use with an exercise device including a selectorized weight stack is provided. The exercise monitoring system includes a static-stack light transmitter for transmitting a reference light to a static-stack reflector and a static-stack receiver positioned to receive reflected reference light from the static-stack reflector. The exercise monitoring system further includes a weight-determination module that outputs a weight indicator based on an amount of reflected static-stack reference light.

DETAILED DESCRIPTION

Exercise monitoring systems in accordance with the present disclosure can be used by one or more users to monitor exercises performed on a variety of different types of exercise machines that utilize one or more weight stacks. Exercise machines in accordance with the present disclosure may be designed for private home use, public gym use, physical therapy and/or rehabilitation, or virtually any other use. Likewise, exercise machines in accordance with the present disclosure may be designed for a single exercise or for a variety of different exercises. Because the disclosed exercise monitoring system cooperates with a common weight stack, it is suitable for use with virtually any machine that includes a weight stack.

Figure 1:
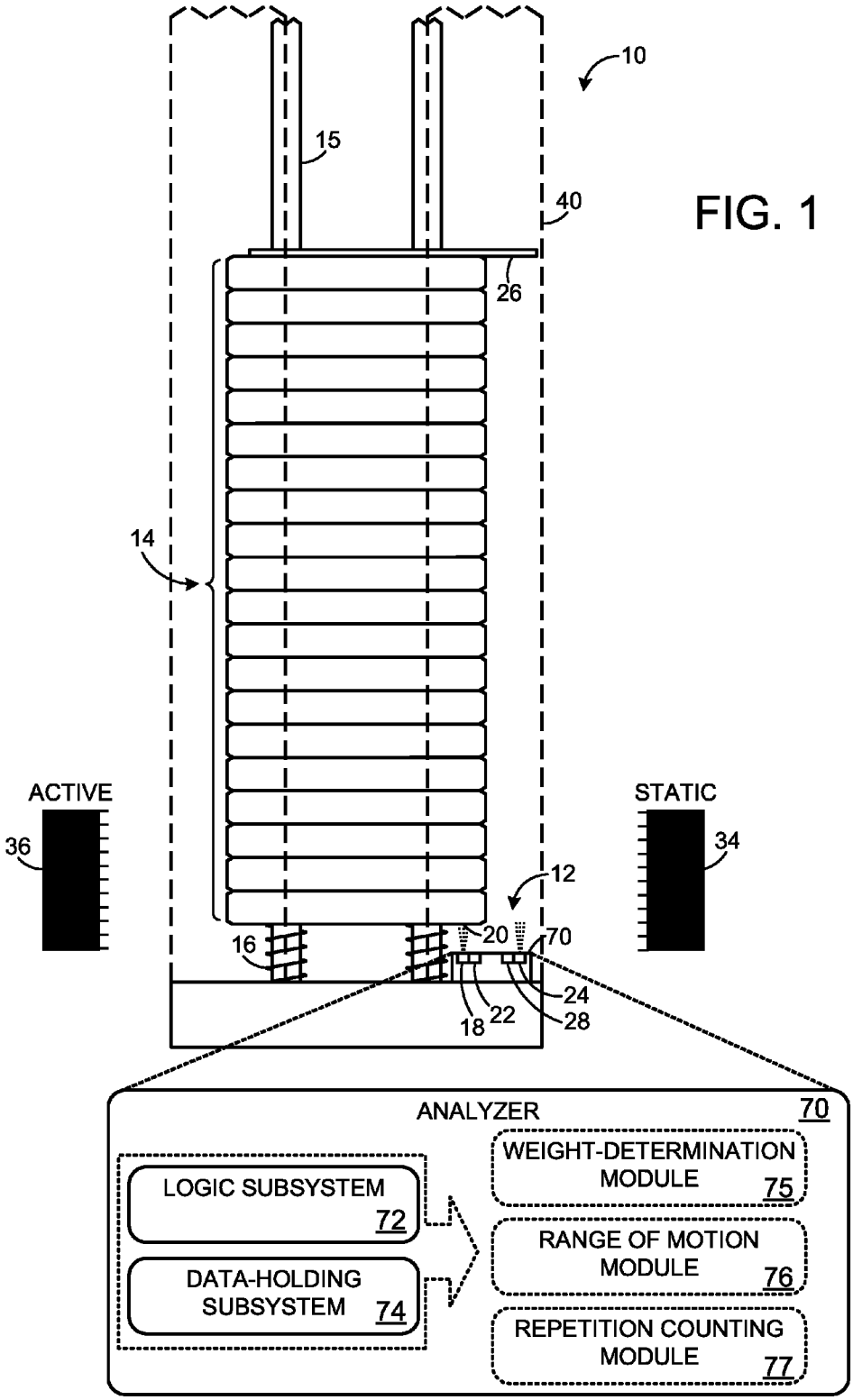
FIG. 1 shows a schematic diagram of an exercise system in accordance with an embodiment of the present disclosure.

FIG. 1 somewhat schematically shows a portion of an exercise system 10 including an exercise monitoring system 12 and a selectorized weight stack 14. Exercise system 10 further includes an analyzer 70 to track and interpret motion of the selectorized weight stack 14. It is noted that the drawings included in this disclosure are schematic. Views of the illustrated embodiments are generally not drawn to scale. Aspect ratios, feature size, and numbers of features may be purposely distorted to make selected features or relationships easier to appreciate. The drawings show exercise monitoring systems and weight stacks without the other components that make up a functional exercise machine because the disclosed exercise monitoring system can be used with virtually any weight stack from virtually any exercise machine.

The selectorized weight stack 14 may include a plurality of weights that may be selectively separated into a static-stack and an active-stack. The active-stack is lifted from the static-stack when a user performs an exercise, as will be described in greater detail below. In some embodiments, the plurality of weights that make up the weight stack 14 of the exercise system 10 may be homogenous (i.e., each weight is the same weight). In other embodiments, the plurality of weights may be heterogeneous (i.e., at least some weights are different than at least some other weights). Furthermore, the plurality of weights in a heterogeneous weight stack may be of varying or uniform density and/or varying or uniform sizes.

The relative number of weights forming the active-stack and the static-stack can be adjusted to change the difficulty of an exercise. In general, more weights in the active-stack correspond to a more difficult exercise (e.g., a leg press machine). However, in some exercise machines, more weights in the active-stack correspond to an easier exercise (e.g., a pull-up assist machine). It is to be understood that the exercise monitoring concepts described herein can be adapted for virtually any type of exercise.

In some embodiments, the herein described methods and processes for tracking exercise information may be tied to a computing system (e.g., analyzer 70 of FIG. 1). As a general example of a suitable computing system, FIG. 1 schematically shows an analyzer 70 that may perform one or more of the herein described methods and processes. Analyzer 70 includes a logic subsystem 72 and a data-holding subsystem 74. Analyzer 70 may optionally include a weight-determination module 75, a range of motion module 76, a repetition counting module 77, and/or other components not shown in FIG. 1.

Logic subsystem 72 may include one or more physical devices configured to execute one or more instructions. For example, the logic subsystem may be configured to execute one or more instructions that are part of one or more programs, routines, objects, components, data structures, or other logical constructs. Such instructions may be implemented to perform a task, implement a data type, transform the state of one or more devices, or otherwise arrive at a desired result. The logic subsystem may include one or more processors that are configured to execute software instructions. Additionally or alternatively, the logic subsystem may include one or more hardware or firmware logic machines configured to execute hardware or firmware instructions. The logic subsystem may optionally include individual components that are distributed throughout two or more devices, which may be remotely located in some embodiments.

Data-holding subsystem 74 may include one or more physical devices configured to hold data and/or instructions executable by the logic subsystem to implement the herein described methods and processes. When such methods and processes are implemented, the state of data-holding subsystem 74 may be transformed (e.g., to hold different data). Data-holding subsystem 74 may include removable media and/or built-in devices. Data-holding subsystem 74 may include optical memory devices, semiconductor memory devices, and/or magnetic memory devices, among others. Data-holding subsystem 74 may include devices with one or more of the following characteristics: volatile, nonvolatile, dynamic, static, read/write, read-only, random access, sequential access, location addressable, file addressable, and content addressable. In some embodiments, logic subsystem 72 and data-holding subsystem 74 may be integrated into one or more common devices, such as an application specific integrated circuit or a system on a chip.

The term "module" may be used to describe an aspect of analyzer 70 that is implemented to perform one or more particular functions. In some cases, such a module may be instantiated, at least in part, via logic subsystem 72 executing or reading instructions or data held by data-holding subsystem 74. It is to be understood that different modules may be instantiated from the same application, code block, object, routine, function, and/or data structure. Likewise, the same module may be cooperatively instantiated by different applications, code blocks, objects, routines, functions, and/or data structures in some cases.

In the illustrated embodiment, analyzer 70 includes a weight-determination module 75, a range of motion module 76, and a repetition counting module 77.

Weight-determination module 75 may be configured to determine and/or output a weight indicator corresponding to an amount of weight lifted by the user. The weight indicator may include a signal, data, and/or another information-sharing mechanism.

Repetition counting module 77 may be configured to output a repetition indicator corresponding to a number of exercise repetitions performed during a set period. The repetition indicator may include a signal, data, and/or another information-sharing mechanism.

Range of motion module 76 may be configured to determine and/or output a range of motion indicator corresponding to a distance the active-stack moves during a repetition of an exercise. The range of motion indicator may include a signal, data, and/or another information-sharing mechanism.

FIGS. 3-6 show examples in which a user (not shown) is lifting a selected amount of weight from the weight stack 14. Herein, weights that are lifted by the exercise system user are referred to as an "active-stack" and weights that are not lifted by the user (e.g., weights that are at rest) are referred to as a "static-stack". As an example, in FIG. 3, the active-stack 30*a* includes six weights and the static-stack 32*a* includes fourteen weights.

The weight stack 14 may be supported by one or more compression springs 16 at the base of one or more guide rods 15 along which the weights move up and down. The compression springs 16 may be extended or compressed in response to the motion of the active-stack. For example, as the active-stack is lifted upward from the static-stack, less weight compresses the springs and the springs extend. When the active-stack is not lifted, but rather is fully supported by the static-stack, the springs support more weight and are compressed. In the example of FIGS. 1 and 3-6, the weight stack 14 is supported by two compression springs 16. In other embodiments, the weight stack may be supported by a single compression spring or more than two compression springs. While a coil spring is illustrated, it is to be understood that any mechanism whose length varies responsive to compressive forces may be used and that all such devices are considered springs for purposes of this disclosure. Further, while the illustrated springs are shown around guide rods 15, other arrangements may be used.

Turning back to FIG. 1, the exercise-monitoring system 12 may include a static-stack light transmitter 18, a static-stack light reflector 20, and a static-stack light receiver 22. The static-stack light transmitter 18 may be positioned to emit light towards the bottom of the weight stack 14 where the static-stack light reflector 20 is located, along an optical path having a length that is proportional to an amount of static weight in the selectorized weight stack. In some embodiments, the static-stack light reflector 20 may be the bottom of the weight stack 14 instead of a separate component, thus decreasing a number of components of the exercise-monitoring system. In some embodiments, the static-stack light reflector 20 may include a white surface or other highly-light-reflective surface. Light that is reflected by the static-stack light reflector 20 is received by the static-stack light receiver 22.

The exercise-monitoring system may further include an active-stack light transmitter 24, an active-stack light reflector 26, and an active-stack light receiver 28. The active-stack light transmitter 24 may be positioned to transmit light to the active-stack light reflector 26 located at the top of the weight stack 14 (e.g., the top of the active-stack). As shown by way of example in FIGS. 1 and 3-6, the active-stack reflector 26 may extend from the top of the active-stack 30 in such a manner so as to be in the path of the light emitted from the active-stack light transmitter 24 in order to reflect light to the active-stack light receiver 28. Other arrangements may be used. In some embodiments, the active-stack light reflector 26 may include a white surface or other highly-light-reflective surface.

In other embodiments, light transmitters and receivers may be used without reflectors. For example, the static-stack light transmitter (or active-stack light transmitter) may remain in the position depicted in FIGS. 1 and 3-6 and the static-stack light receiver (or active-stack light receiver) may take the position of the static-stack light reflector (or active-stack light reflector). In other embodiments, the positions of the transmitters and the receivers can be reversed. In any case, the length of the optical path remains proportional to an amount of static weight in the selectorized weight stack and/or the distance the active-stack is lifted above the static-stack.

An amount, or intensity, of reference light reflected to the static-stack light receiver 22 and the active-stack light receiver 28 may depend on the distance between the reflector and the receiver based on the principle of the inverse square law. For example, the intensity of light reflected from the reflector (active-stack or static-stack) to the receiver (active-stack or static-stack) may decrease proportionally to the square of the distance between the reflector and the receiver. As such, the closer the reflector is to the receiver, the greater the amount of light the receiver will receive. In FIGS. 1 and 3-6, the relative intensity of received light is schematically represented by a level indicator 34 for the static-stack and a level indicator 36 for the active-stack. The amount of reference light received by the active- and/or static-stack light receivers may be used by an analyzer 70 to output information regarding various factors about the exercise being performed, such as range of motion, amount of weight lifted, and number of repetitions. Further examples will be described below with reference to FIGS. 2-6.

Figure 2A:
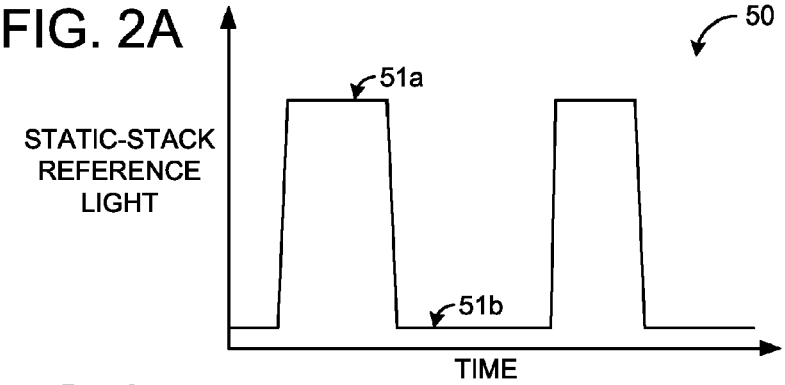
FIGS. 2A-2D shows a series of graphs illustrating example light signals from an exercise monitoring system.
Figure 2B:
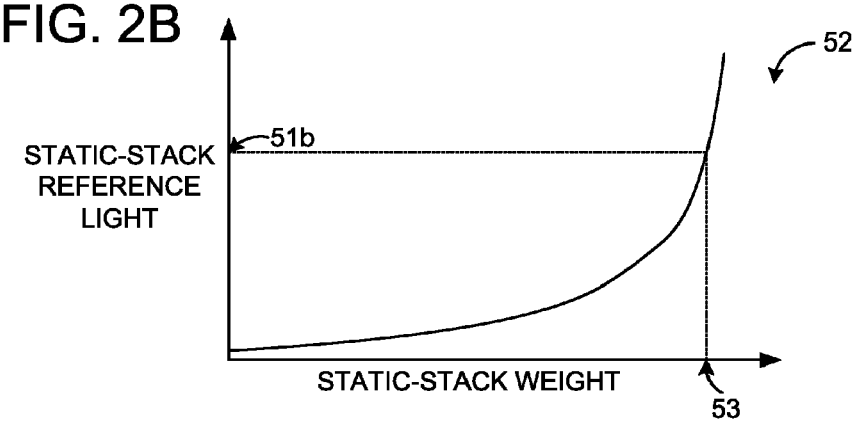
Figure 2C:
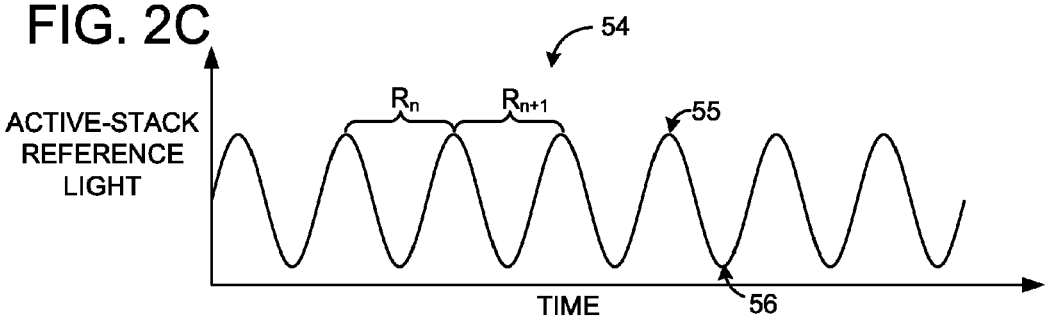
Figure 2D:
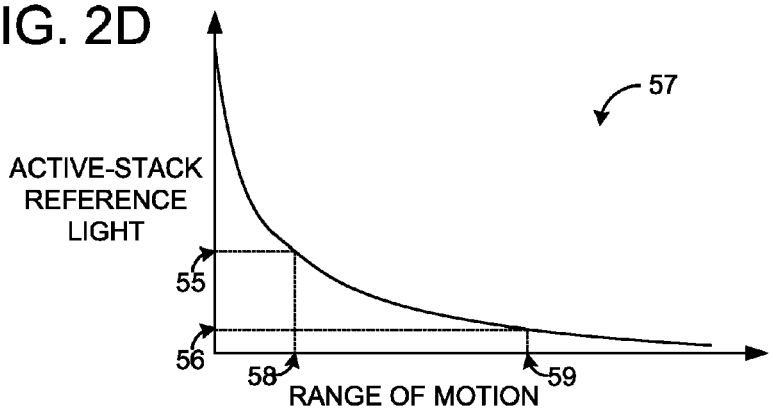

Examples of reference light plots are shown in FIGS. 2A and 2C, and lookup graphs for correlating the amount of reference light to various exercise parameters are shown in FIGS. 2B and 2D. For example, light plot 50 in FIG. 2A shows an example of an amount of static-stack reference light received over time (e.g., as a user moves an active-stack up and down). Local maximum 51*a* of static-stack reference light corresponds to a maximum amount of static-stack weight (e.g., when an active-stack is not lifted by a user). Local minimum 51*b* of static-stack reference light corresponds to the amount of static-stack weight that remains while a user lifts the active-stack away from the static stack.

The weight of the static-stack may be determined from information such as that shown in lookup graph 52 of FIG. 2B. Lookup graph 52 correlates the amount of static-stack reference light received to an amount of static-stack weight. Using such a graph, or another similar type of lookup table, the static-stack weight for a given amount of static-stack reference light can be found. Using the example of FIG. 2A, lookup graph 52 may be used to find a static-stack weight 53 that corresponds to local minimum 51*b*. Lookup graph 52 may be calibrated in any suitable manner.

Light plot 50 may also be used to determine the total length of time that an athlete has the active stack in use.

As another example, light plot 54 in FIG. 2C shows an amount of active-stack reference light received over time (e.g., as a user lifts the active-stack up and down). Local maximum 55 corresponds to a time when the active-stack is not lifted and local minimum 56 corresponds to a time when the active-stack is as far from the active-stack as it may get. As shown in light plot 54, one period $R_n$, between two maxima (or minima) may correspond to one repetition of an exercise.

The range of motion of the active-stack may be determined from information such as that shown in lookup graph 57 of FIG. 2D. Lookup graph 57 correlates the amount of active-stack reference light received to a range of motion. Using such a lookup graph, or another similar type of lookup table, the active-stack position for a given amount of active-stack reference light can be found. Using the example of FIG. 2C, lookup graph 57 may be used to find an active-stack position 58 that corresponds to local maximum 55, and an active-stack position 59 that corresponds to local minimum 56. The range of motion of an exercise repetition may be determined based on the difference between these two positions of the active stack. In some embodiments, an estimate of a range of motion may be calculated using the assumption that each exercise repetition returns the active stack to the static stack.

Turning back to FIG. 1, in order to reduce interference from ambient light in the environment where the exercise system 10 is located, in some embodiments, exercise system 10 may further include a protective shroud 40 which surrounds the optical path of the light transmitters, receivers, and/or reflectors. In some embodiments, the active- and/or static-stack light transmitter may be turned on and off at a rapid rate and the received light intensity may be measured in both conditions. The smaller received light intensity value (e.g., when only ambient light is received) may then be subtracted from the greater received light intensity value (e.g., when ambient light and reflected light are received) in order to determine the relative contribution of light reflected from the reflector. In some embodiments, a particular wavelength or range of wavelengths of light (e.g., visible, infrared, etc.) may be selected to be transmitted from the active- and/or static-stack transmitters so as to reduce interference from ambient light. Light with a particular polarization may also be used to help increase the signal-to-noise ratio with respect to ambient light.

Furthermore, in other embodiments, the active- and/or static-stack light transmitters, reflectors, and receivers may be of a different form. For example, in one embodiment, a strain gauge may be used in place of the static-stack transmitter, reflector, and receiver, and the weight stack (or static-stack) may rest directly on the strain gauge. In another embodiment, the light transmitter, reflectors, and receivers may be replaced by a linear transducer, and a resistance or capacitance of the transducer may be proportional to the distances described above.

Figure 3:
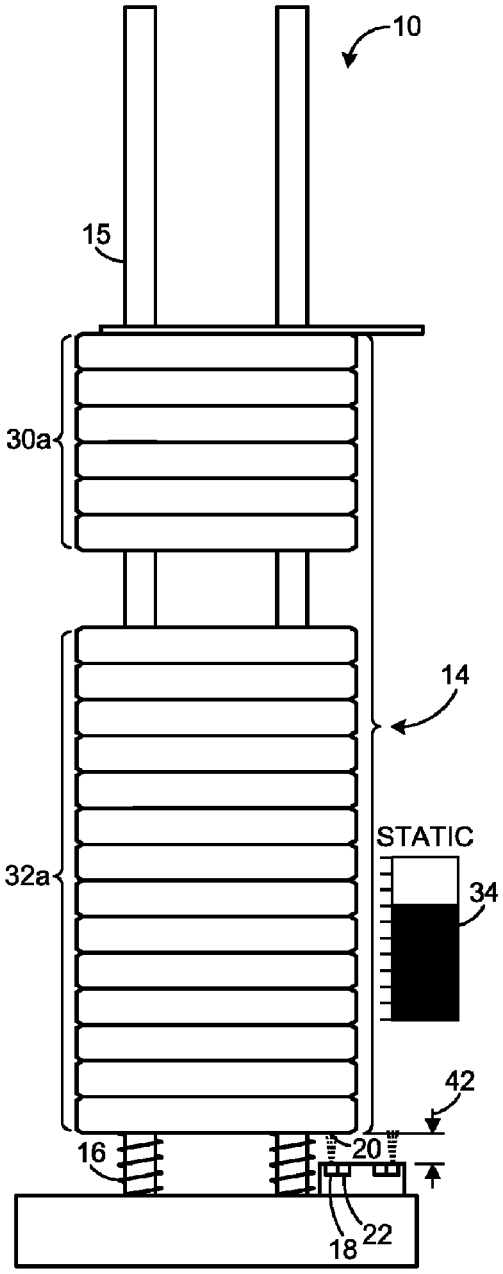
FIG. 3 shows a second schematic diagram of an exercise system in accordance with an embodiment of the present disclosure.

As shown schematically in FIG. 1, the exercise-monitoring system 12 may include a weight-determination module 75 which may determine the amount of weight lifted by the user. For example, as shown in FIG. 1, when the weight stack 14 is at rest (e.g., a user is not lifting the active-stack), the level indicator 34 shows the relative static-stack light intensity is at a maximum (i.e., 100%). In FIG. 3, when the active-stack 30*a* includes six weights lifted off of the static-stack 32*a*, springs 16 push the light reflector 20 further away from the static-stack light transmitter 18 and the static-stack light receiver 22. As a result, the relative amount of static-stack reference light received by the static-stack light receiver, as indicated at 34, is less (e.g., 70%).

Figure 4:
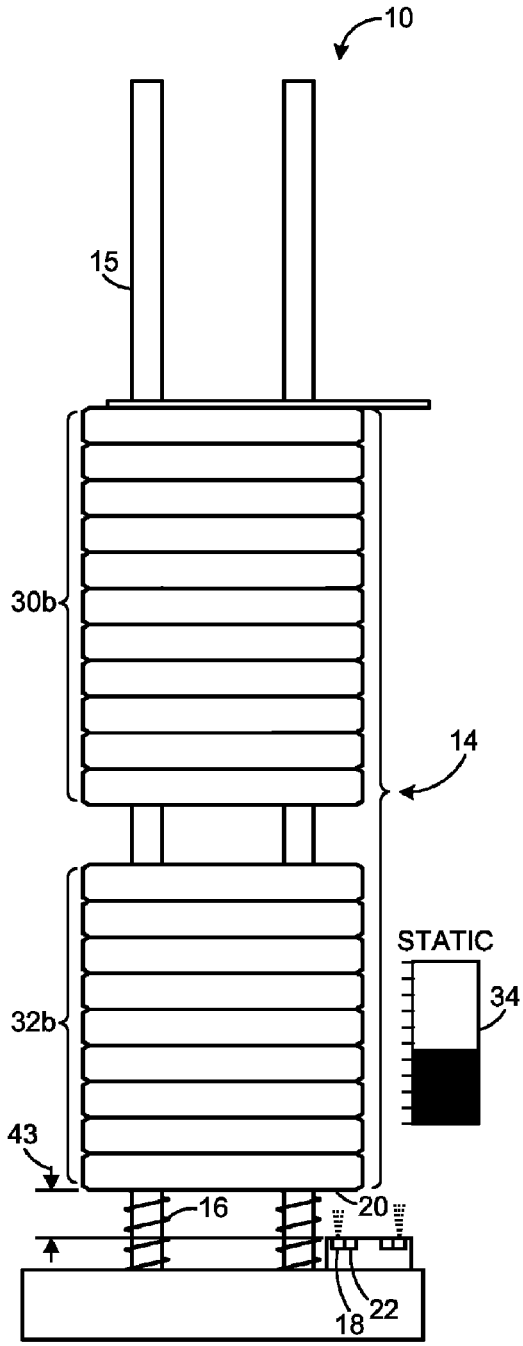
FIG. 4 shows a third schematic diagram of an exercise system in accordance with an embodiment of the present disclosure.

The weight-determination module 75 may use the amount of static-stack reference light received by the static-stack light receiver 22 to determine the distance between the static-stack light reflector 20 and static-stack light receiver 22 (e.g., distances 42 and 43 in FIGS. 3 and 4, respectively). The amount of weight loaded on the springs 16 may then be calculated from this distance and subtracted from the total weight, thus resulting in the amount of weight lifted by the user.

In the example shown in FIG. 4, the active-stack 30*b* includes eleven weights. Because the static-stack 32*b* in FIG. 4 weighs less than the static-stack 32*a*, the springs 16 extend and the distance between the static-stack light reflector 20 and static-stack light receiver 22 increases, as indicated at 43. The level indicator 34 in FIG. 4 shows a relative static-stack light intensity of 45%, which is lower than the 70% relative static-stack light intensity indicated in FIG. 3, thus indicating the bottom of the weight stack 14 is farther away from the receiver in FIG. 3. Furthermore, the amount of static-stack reference light received by the static-stack receiver 22 may be utilized by the weight-determination module 75 to output an indicator corresponding to the amount of weight lifted by the user (e.g., the weight of the active-stack 30*b*). As an example, the weight-determination module 75 may use a lookup graph, table, or algorithm, as described with reference to FIG. 2B, to correlate light intensity to weight.

Figure 5:
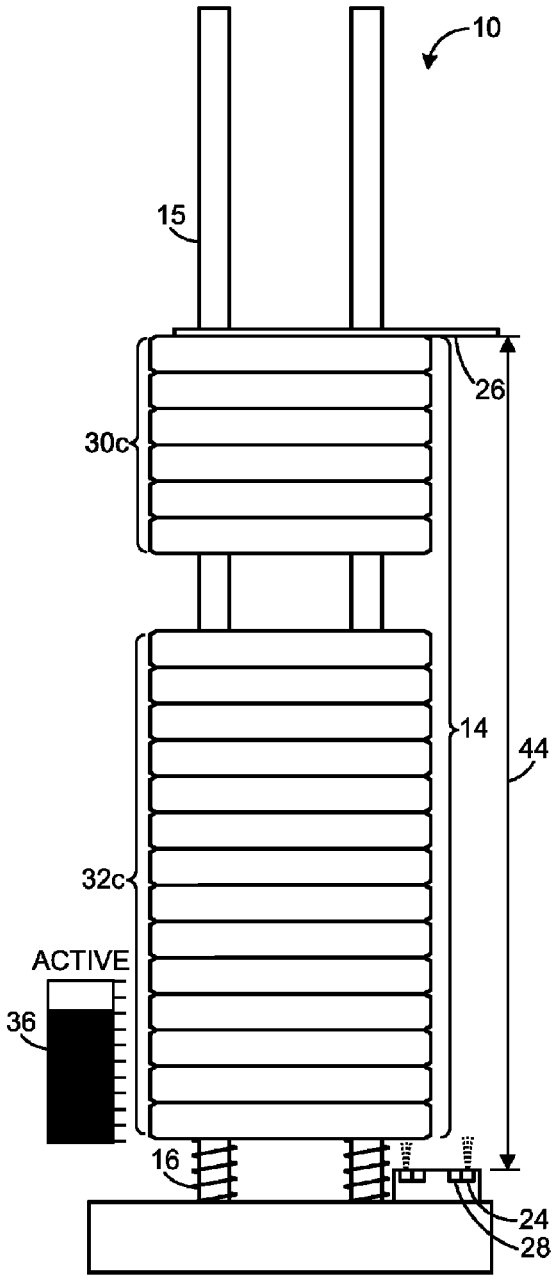
FIG. 5 shows a fourth schematic diagram of an exercise system in accordance with an embodiment of the present disclosure.

As shown schematically in FIG. 1, the exercise-monitoring system 12 may further include a range of motion module 76 which may determine the range of motion for a repetition of the exercise performed by the user. As shown in the example of FIG. 1, the level indicator 36 shows the relative active-stack light intensity is at a maximum (i.e., 100%) when the weight stack 14 is at rest. Referring now to FIG. 5, an example is shown in which the active-stack 30*c* includes six weights. As shown by the level indicator 36 representing the relative active-stack light intensity, the relative intensity of reflected active-stack reference light is 80%. Thus, the amount of light received by the active-stack light receiver 28 is less in the example of FIG. 5 than in the example of FIG. 1 due to the active-stack 30*c* being lifted from the static-stack 32*c* (e.g., distance 44 in FIG. 5) and the active-stack light reflector 26 moving farther from the active-stack light receiver 28. Further, in the example of FIG. 6, the active-stack 30*d* is lifted (e.g., distance 45 in FIG. 6) even farther from the static-stack 32*d* as indicated by the level indicator 36 which shows a relative active-stack light intensity of 40%.

Figure 6:
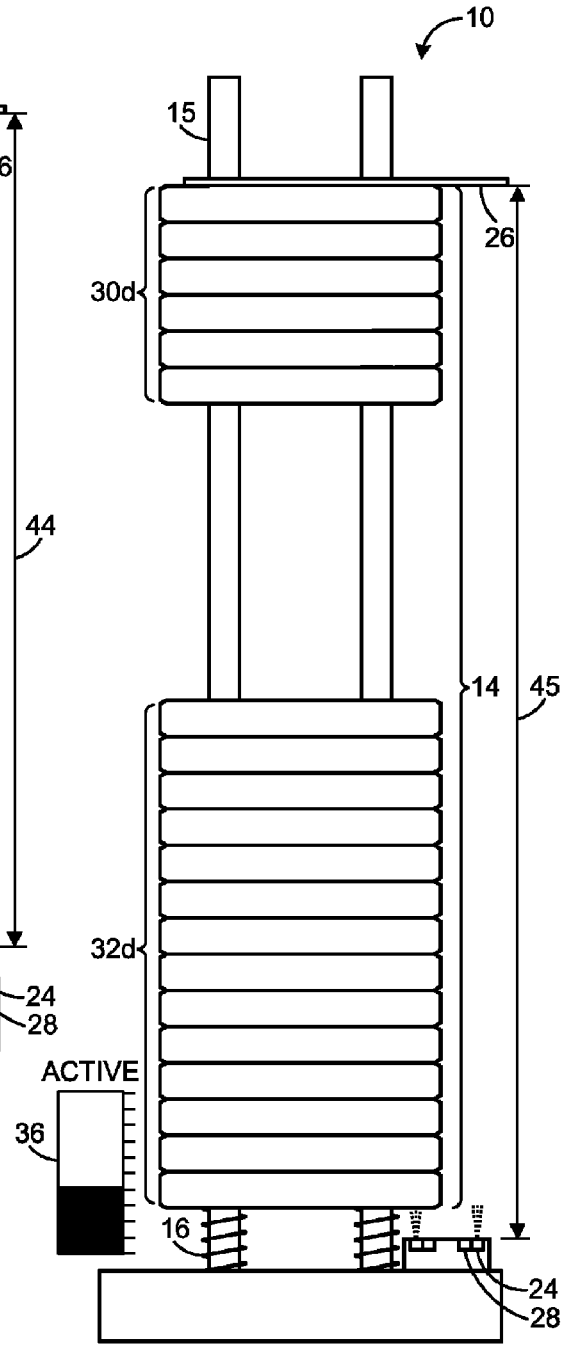
FIG. 6 shows a fifth schematic diagram of an exercise system in accordance with an embodiment of the present disclosure.

As described above, as the active-stack moves away from the static-stack, and thus, the active-stack reflector 26 moves farther away from the active-stack receiver 28, the amount of light received by the active-stack receiver 28 decreases. The range of motion of one repetition of an exercise may correspond to the minimum amount of light received by the active-stack receiver 28 during the repetition, and the smaller the amount of light received, the greater the range of motion. For example, the range of motion in FIG. 6 is greater than the range of motion in FIG. 5. Range of motion module 76 can be configured to correlate the minimum amount of active-stack reference light to the range of motion. As an example, range of motion module 76 may use a lookup graph, table, or algorithm, as described with reference to FIG. 2D, to correlate light intensity to range of motion.

As shown schematically in FIG. 1, the exercise-monitoring system 12 may further include a repetition counting module 77 which may give an indication corresponding to a number of repetitions of an exercise. Similar to the range of motion module 76, the repetition counting module 77 may determine a number of repetitions based on the received active-stack reference light. For example, in some embodiments, a number of repetitions may be determined during a selected time period by counting a number of relative minimum and maximum active-stack reference light values (e.g., each period beginning with a local maximum active-stack reference light, changing to a local minimum active-stack reference light, and returning to a local maximum active-stack reference light corresponds to one repetition). In other embodiments, a repetition count may be generated after a certain amount of time has passed after a minimum amount of light is detected by the active-stack light receiver.

Returning to FIG. 1, analyzer 70 may include a visual display and/or audio generator for reporting weight, repetition, range of motion, and/or other information to a user. Analyzer 70 may additionally and/or alternatively include a communication channel for reporting such information to another device, such as a networked computing system, a portable computing device, a personal exercise monitoring device, and/or any device with a compatible communication channel. Nonlimiting examples of such communication channels include Universal Serial Bus (USB), IEEE 802.15.x, IEEE 802.11x, IEEE 802.3x, IEEE 1394x, and the like.

Figure 7:
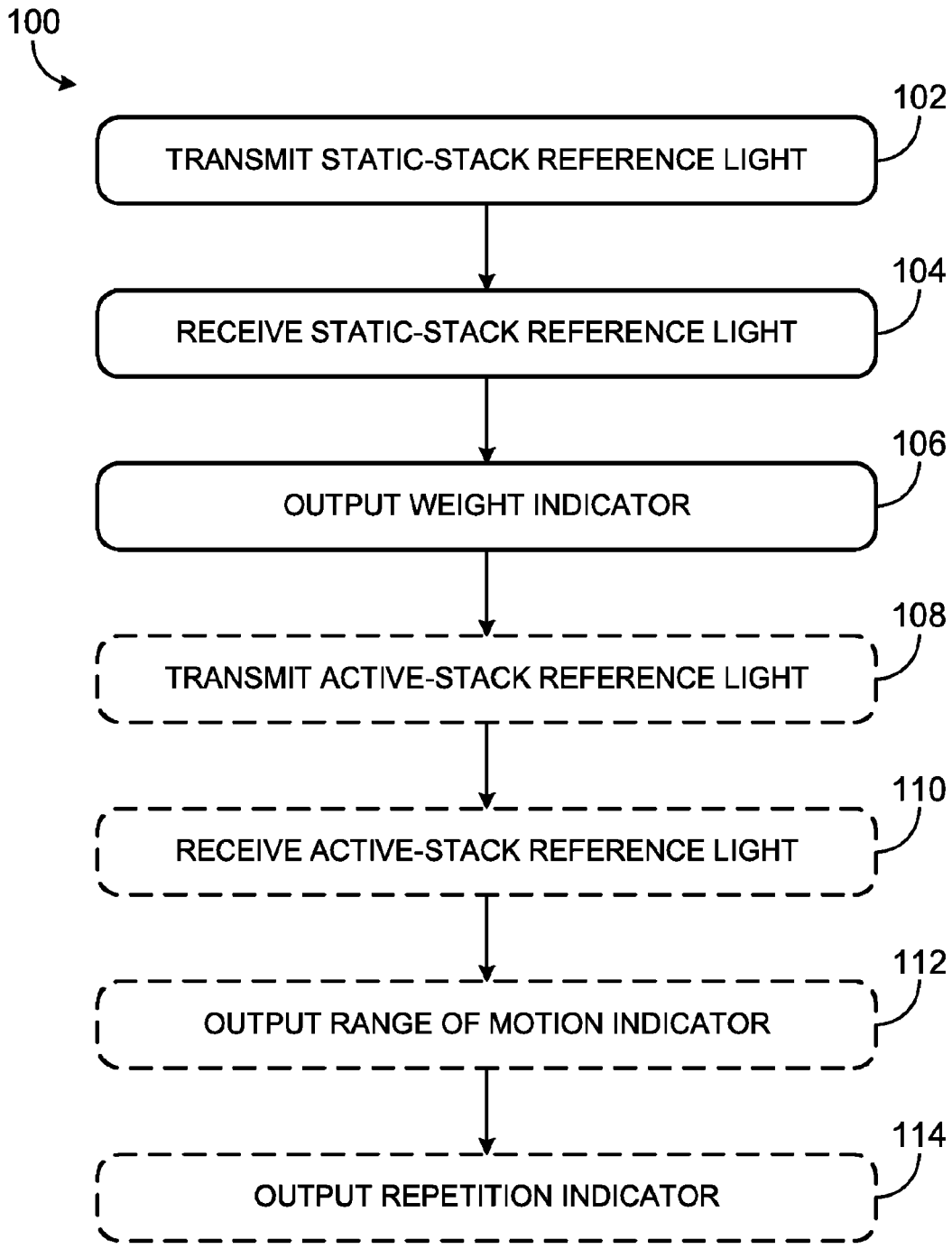
FIG. 7 shows a flow chart illustrating a method of monitoring an exercise.

Finally, FIG. 7 shows a high level flow chart illustrating a method 100 for an exercise monitoring system, such as exercise monitoring system 12 depicted in FIG. 1. At 102, method 100 includes transmitting static-stack reference light along an optical path having a length that is proportional to an amount of static-stack weight in a selectorized weight stack. The static-stack reference light is received at 104 of method 100. Once the static-stack reference light is received, method 100 proceeds to 106 where a weight indicator is output based on the amount of received static-stack reference light.

As described above, in some embodiments, the exercise monitoring system may include an active-stack light transmitter. In such an embodiment, active-stack reference light is transmitted along an optical path having a length that is proportional to a range of motion of the active-stack at 108 of method 100. The active-stack reference light is then received at 110. At 112 of method 100, a range of motion indicator is output based on the amount of received active-stack reference light. Additionally, a repetition indicator may be output at 114 of method 100 based on the amount of received active-stack reference light.

It is to be understood that the configurations and/or approaches described herein are exemplary in nature, and that these specific embodiments or examples are not to be considered in a limiting sense, because numerous variations are possible. The specific routines or methods described herein may represent one or more of any number of processing strategies. As such, various acts illustrated may be performed in the sequence illustrated, in other sequences, in parallel, or in some cases omitted. Likewise, the order of the above-described processes may be changed.

The subject matter of the present disclosure includes all novel and nonobvious combinations and subcombinations of the various processes, systems and configurations, and other features, functions, acts, and/or properties disclosed herein, as well as any and all equivalents thereof.

The invention claimed is:

1. An exercise-monitoring system for use with an exercise device including a selectorized weight stack including a plurality of weights that are separated into a static-stack that is not lifted during an exercise and an active-stack that is lifted from the static-stack during the exercise, the exercise-monitoring system comprising:

a static-stack light transmitter positioned to transmit a static-stack reference light to a static-stack reflector operatively connected to the static-stack, the static-stack reference light transmitted in a direction the static-stack reflector moves when the active-stack is lifted from the static-stack;

a static-stack light receiver positioned to receive from the static-stack reflector an amount of reflected static-stack reference light that is proportional to a distance between the static-stack reflector and the static-stack light receiver; and a weight-determination module to output a weight indicator based on the amount of reflected static-stack reference light received by the static-stack light receiver.

2. The exercise-monitoring system of claim 1, wherein a ratio of the active-stack to the static-stack is selectable by a user.

3. The exercise-monitoring system of claim 2, further comprising an active-stack light transmitter positioned to transmit an active-stack reference light to an active-stack light reflector throughout a range of motion of the active-stack reflector and an active-stack light receiver positioned to receive an amount of the active-stack reference light from the active-stack reflector that is proportional to a distance between the active-stack light reflector and the active-stack light receiver.

4. The exercise-monitoring system of claim 3, further comprising a range of motion module to output a range of motion indicator based on the amount of reflected active-stack reference light received by the active-stack light receiver.

5. The exercise-monitoring system of claim 4, wherein the range of motion indicator corresponds to a distance the user moves the active-stack during the exercise.

6. The exercise-monitoring system of claim 5, wherein the range of motion module correlates a local minimum amount of light received by the active-stack light receiver to a range of motion for one repetition of the exercise.

7. The exercise-monitoring system of claim 6, further comprising a repetition counting module to output a repetition indicator based on the active-stack reference light received by the active-stack light receiver.

8. The exercise-monitoring system of claim 7, wherein the repetition counting module correlates a number of relative minimum and maximum active-stack reference light values to a number of repetitions of the exercise.

9. The exercise-monitoring system of claim 1, further comprising a shroud configured to block ambient light from the static-stack light receiver while allowing the static-stack reference light to reflect from the static-stack light transmitter to the static-stack light receiver.

10. The exercise-monitoring system of claim 1, wherein the static-stack reflector is operatively coupled to a bottom-most weight in the static-stack.

11. An exercise system comprising:

a selectorized weight stack including a plurality of weights that are selectively separated into a static-stack and an active-stack that is lifted from the static-stack when a user performs an exercise;

one or more compression springs supporting the selectorized weight stack;

a static-stack light reflector located on the static-stack;

a static-stack light transmitter positioned to transmit a static-stack reference light to the static-stack reflector in a direction the static-stack reflector moves when the active-stack is lifted from the static-stack;

a static-stack light receiver positioned to receive from the static-stack reflector an amount of reflected static-stack reference light that is proportional to a distance between the static-stack reflector and the static-stack light receiver;

an active-stack light reflector located on the active-stack;

an active-stack light transmitter positioned to transmit an active-stack reference light to the active-stack reflector throughout a range of motion of the active-stack reflector;

an active-stack light receiver positioned to receive an amount of the active-stack reference light from the active-stack reflector that is proportional to a distance between the active-stack reflector and the active-stack light receiver;

a weight-determination module to output a weight indicator based on the amount of reflected static-stack reference light received by the static-stack light receiver; and a repetition counting module to output a repetition indicator based on the active-stack reference light received by the active-stack light receiver.

12. The exercise system of claim 11, further comprising a range of motion module to output a range of motion indicator based on the amount of reflected active-stack reference light received by the active-stack light receiver.

13. The exercise system of claim 12, wherein the range of motion indicator for one repetition of the exercise corresponds to a minimum amount of reflected active-stack reference light received by the active-stack light receiver.

14. The exercise system of claim 11, wherein the repetition indicator represents a count of a number of minimum amounts of active-stack reference light received by the active-stack light receiver during the exercise.

15. The exercise system of claim 11, wherein the weight indicator corresponds to an amount of weight selected by the user.

16. A method of monitoring an exercise performed using a selectorized weight stack including a plurality of weights that are selectively separated into a static-stack and an active-stack that is lifted from the static-stack, the method comprising:

transmitting with a static-stack light transmitter a static-stack reference light along an optical path having a length that is proportional to an amount of static weight in the static-stack when active weight is lifted from static weight, the optical path being substantially parallel to a direction the static-stack of the selectorized weight stack moves when active weight is lifted from static weight;

receiving with a static-stack light receiver the static-stack reference light; and outputting a weight indicator based on an amount of received static-stack reference light.

17. The method of claim 16, further comprising reflecting the static-stack reference light with a static-stack reflector located on a bottom-most weight of the static-stack of the selectorized weight stack.

18. The method of claim 16, further comprising: transmitting with an active-stack light transmitter an active-stack reference light along an optical path having a length that is proportional to a range of motion of the active-stack;

receiving with an active-stack light receiver the active-stack reference light;

outputting a range of motion indicator based on an amount of received active-stack reference light; and outputting a repetition indicator based on the received active-stack reference light.

* * * * *